US007159627B2

(12) United States Patent
St-Germain et al.

(10) Patent No.: US 7,159,627 B2
(45) Date of Patent: Jan. 9, 2007

(54) MANUAL LOG SPLITTING DEVICE

(75) Inventors: André St-Germain, St.Bonaventure (CA); Guy Maurice, Beloeil (CA); Englebert Otis, St.Bonaventure (CA)

(73) Assignee: L&S Systemes Andro Inc.

( * ) Notice: Subject to any disclaimer, the term of this patent is extended or adjusted under 35 U.S.C. 154(b) by 0 days.

(21) Appl. No.: 11/269,653

(22) Filed: Nov. 9, 2005

(65) Prior Publication Data

US 2006/0096666 A1 May 11, 2006

Related U.S. Application Data

(60) Provisional application No. 60/625,980, filed on Nov. 9, 2004.

(51) Int. Cl.
*B27L 7/06* (2006.01)

(52) U.S. Cl. ..... 144/195.5; 144/195.8; 144/195.7

(58) Field of Classification Search ..... 144/193.2, 144/195.2, 195.4–195.8, 195.1; 173/90, 173/91; 254/104; 17/90, 91
See application file for complete search history.

(56) References Cited

U.S. PATENT DOCUMENTS

| | | | | |
|---|---|---|---|---|
| 4,274,458 | A | 6/1981 | Dueweke et al. | |
| 4,275,779 | A * | 6/1981 | Rowe | 144/195.1 |
| 4,308,903 | A | 1/1982 | Alloway | |
| 4,362,194 | A | 12/1982 | Lawson | |
| 4,379,475 | A * | 4/1983 | Nokes | 144/195.5 |
| 4,405,005 | A * | 9/1983 | Zanker | 144/195.5 |
| 4,905,746 | A * | 3/1990 | Bedard | 144/195.7 |
| 5,495,878 | A | 3/1996 | McKenen, Jr. | |
| 6,453,958 | B1 * | 9/2002 | Slavich | 144/195.5 |

* cited by examiner

*Primary Examiner*—Shelley Self
(74) *Attorney, Agent, or Firm*—Equiuox Int'l; Frauz Bousang, Patent Agent

(57) ABSTRACT

A manual log splitting device for splitting a log has a first assembly including a base plate for resting of the log and a first upright extending upwardly from the base plate. A second assembly having an upright sleeve, impact plate, and wedge assembly, is axially and slidably mounted on the first upright with the upright sleeve. A user splits the log by causing the second assembly to move towards the base plate such that the wedge assembly passes through and splits the log. A receptacle abuttingly engages the upright sleeve and the base plate when the second assembly is in a resting position where the wedge assembly is slightly spaced apart from the base plate. Thus, movement of the second assembly towards the base plate beyond the resting position, and contact therebetween, is prevented.

23 Claims, 7 Drawing Sheets

MANUAL LOG SPLITTING DEVICE

CROSS REFERENCE TO RELATED APPLICATIONS

Benefit of U.S. Provisional Application for Patent Ser. No. 60/625,980, filed on Nov. 9, 2004, is hereby claimed.

FIELD OF THE INVENTION

The present invention relates in general to log-splitting devices and in particular to manually-operated log-splitting devices.

BACKGROUND OF THE INVENTION

Most manually-operated log-splitting devices, whether mounted or hand-held, are designed for use by a single operator and require the use of a sledgehammer or some other impacting device similar in nature to effectuate a split in the log. Performance of this task is arduous and can be dangerous, the situation being made more so when the wedge becomes inextricably embedded in the log. Many improved methods have been developed to solve these problems the most successful notably being the development of more powerful mechanical log-splitting devices. These devices being mechanical in nature are clearly more complicated and therefore more costly as a result. Improvements in manual log splitters are many and varied but few have incorporated radical and composite alterations to the design of the splitting wedge itself nor have they addressed safety concerns inherent in the proper use of such a device.

Accordingly, there is a need for an improved manual log splitting device.

SUMMARY OF THE INVENTION

It is therefore a general object of the present invention to provide an improved manual log splitting device.

An advantage of the present invention is that it has a wedge assembly for splitting the log which is designed for promoting the reduction of friction between the wedge assembly and the log during splitting.

Another advantage of the present invention is that the wedge assembly is axially mounted on a first upright that is removably engageable to a base plate.

A further advantage of the present invention is that the first upright is designed to prevent rotation of the wedge assembly thereabout during its displacement therealong, thus facilitating splitting and providing additional safety.

Another advantage of the present invention is that the log splitter is a relatively safe log splitting device which includes a plunger designed in such a way as to impede the operator's hands from coming into contact with log splits, i.e. portions of the log, during the splitting process.

Still another advantage of the present invention is that the log splitter has a design that incorporates a means for preventing the wedges of wedge assembly from coming into contact with contact with the feet (or other body parts) of the operator and the base plate.

Yet another advantage of the present invention is that the log splitting device can be alternately utilized by two operators.

According to an aspect of the present invention, there is provided a log splitting device for splitting logs, the device comprises:

a first assembly comprising a base plate for resting of at least one log during splitting of said log and a first upright supported by and extending upwardly from said base plate;

a second assembly comprising an upright sleeve having a first upright sleeve axis, an impact plate attached to said upright sleeve and extending substantially radially therefrom, a second upright attached to the impact plate and extending upwardly therefrom, a plunger axially and slidably mounted on the second upright, and at least one wedge assembly extending substantially axially away from said impact plate towards said base plate, said upright sleeve being axially and slidably engageable by said first upright for displacement of said second assembly therealong with said wedge assembly facing towards said base plate for splitting said log by passage therethrough when said second assembly is moved towards the base plate upon said first upright by a downwardly directed force applied by a user by sliding the plunger on the second upright from a raised position above the impact plate downwardly towards the impact plate and impacting the impact plate; and abutting engagement means for selectively abuttingly engaging said upright sleeve and said base plate when second assembly is in a resting position in which said wedge is slightly vertically spaced apart from said base plate for preventing further movement of said second assembly theretowards.

Other objects and advantages of the present invention will become apparent from a careful reading of the detailed description provided herein, with appropriate reference to the accompanying drawings.

BRIEF DESCRIPTION OF THE DRAWINGS

Further aspects and advantages of the present invention will become better understood with reference to the description in association with the following Figures, in which similar references used in different Figures denote similar components, wherein.

DETAILED DESCRIPTION OF THE PREFERRED EMBODIMENTS

With reference to the annexed drawings the preferred embodiments of the present invention will be herein described for indicative purpose and by no means as of limitation.

Figure 1:
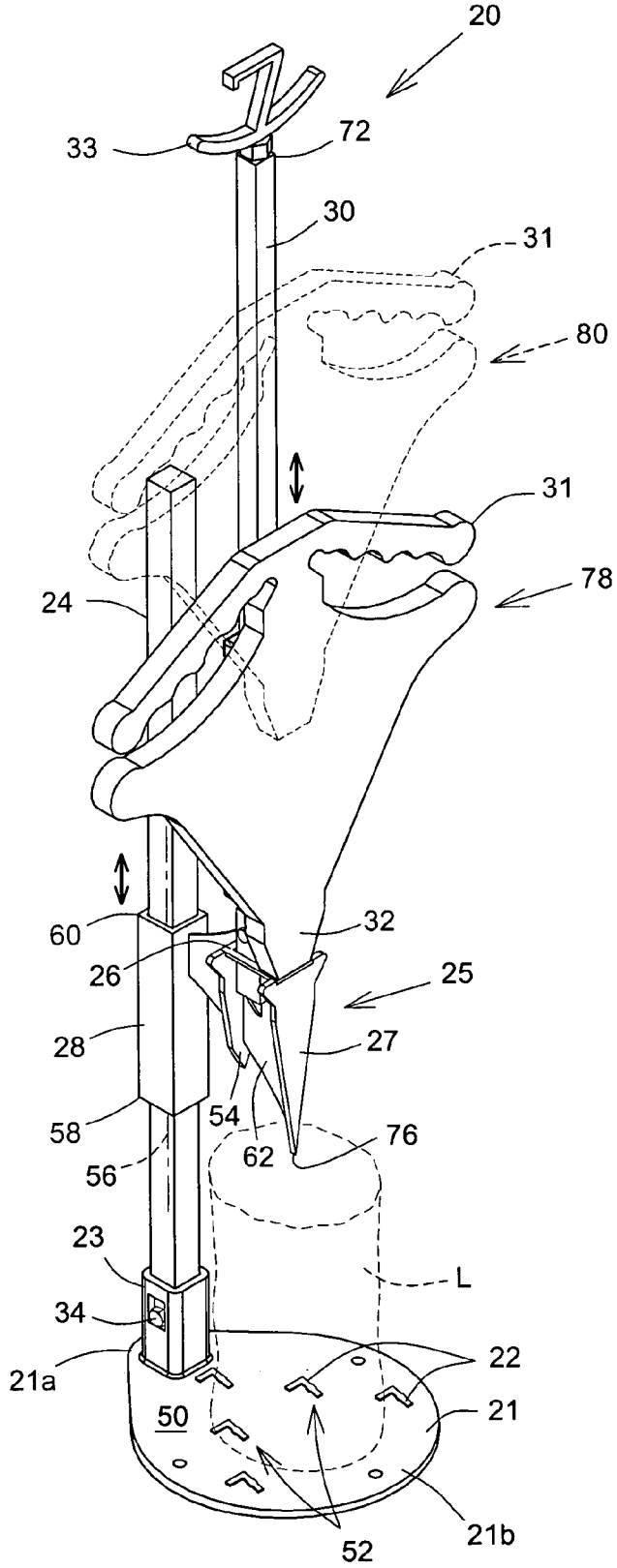
FIG. 1 is a top perspective view of a manual log splitting device in accordance with an embodiment of the present invention.

Reference is now made to FIG. 1 to provide a brief overview of the invention. Manual log splitting device 20 is almost totally composed of cast iron. Base plate 21 of device 20 is typically made out of cast iron or the like and is typically circular in shape. Also depicted is first upright 24, shown as a metal shaft of quadrilateral shape, which is supported by base plate 21 and which extends upwardly therefrom. Additionally depicted is upright sleeve 28 having a first upright sleeve axis 56. Upright sleeve 28 and first upright 24 are slidably and axially engageable with each other, thus rendering upright sleeve 28 slidably and axially engageable with first upright 24 for displacement of upright sleeve 28 therealong. Impact plate 26 extends substantially radially from upright sleeve 28 relative first upright sleeve axis 56, i.e. in substantial perpendicular alignment relative upright sleeve 28. Wedge assembly, shown generally as 25, extends substantially axially away from impact plate 26, i.e. perpendicularly away therefrom, towards upright sleeve bottom end 58, situated generally longitudinally opposite upright sleeve top end 60. Wedge assembly 25 is typically made out of one of more wedges 27, 54 made of cast iron or the like, and which extend substantially axially away from impact plate 26, as well as a blade plate 62 which extends between first wedge 27 through second wedge 54 to upright sleeve 28. Wedge assembly 25 faces base plate 21 when upright sleeve 28 is engaged, i.e. mounted, on first upright 24 and splits log L when a downwardly directed force causes wedge assembly 25 to pass through log L, thereby effecting the splitting of log L, until an abutting engagement means 23 stops further movement of wedge assembly 25 towards base plate 21. The user applies the downwardly directed force by exerting a force downwardly upon plunger 31, also typically made out of cast iron or the like, which is axially and slidably mounted upon second upright 30, attached to impact plate 26 and extending upwardly therefrom with plunger cap 33 releasably fastened thereto. More specifically, user moves plunger 31 from a raised position, where plunger 31 is spaced apart from impact plate 26 and situated thereabove, toward impact plate 26 by applying downward force on plunger 31. The plunger 31 then impacts impact plate 26 and applies the downwardly directed force thereto to split log L with wedge assembly 25.

Figure 2:
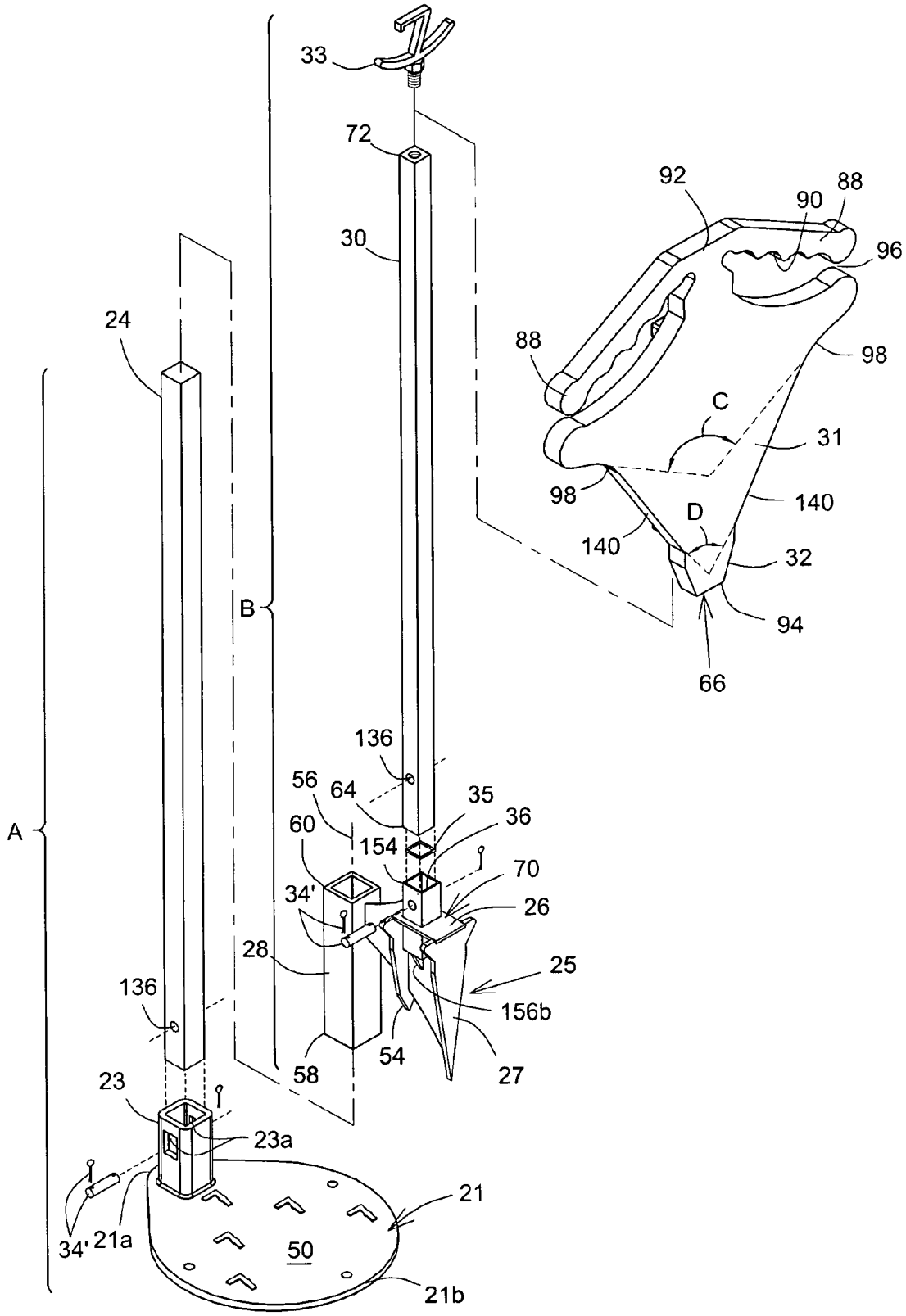
FIG. 2 is an exploded top perspective view of the manual log splitting device shown in FIG. 1.
Figure 3:
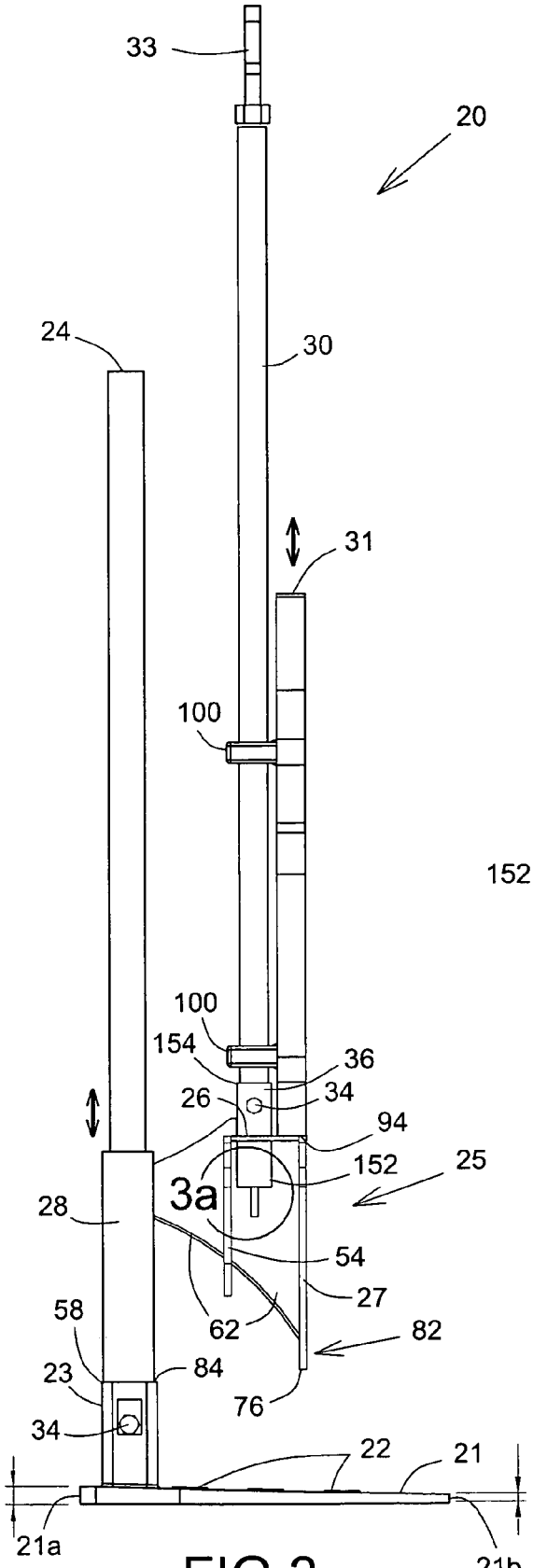
FIG. 3 is a side elevational view of the manual log splitting device shown in FIG. 1.

To provide details on assembly of log splitting device 20, reference is now made, in conjunction with FIG. 1, to FIGS. 2, 3, and 3*a*. First upright 24 is vertically inserted into first receptacle 23 of the base plate 21 and secured in place with conventional fasteners 34 being a nut, bolt and washer assembly, shown in FIG. 1, or a Teflon™ (or other suitable material that can support the forces and preferably lower any impact noise) shaft and cotter pin assembly 34' shown in FIG. 2. The bolt or the pin extend along a transversal bore 136 of the first upright 24 and protrude therefrom to abut or rest on the first receptacle 23 or lateral openings 23*a*, best shown in F*ig*. 3, thereof. Accordingly, first upright 24 is securely and releasably engageable in first receptacle 23. As will be explained below, first receptacle 23 also constitutes the abutment protrusion of the abutting engagement means which abuts upright sleeve 28 and base plate 21, as shown in FIG. 3. This consolidation of elements of the present invention constitutes First Assembly A, shown in FIG. 2.

Figure 3A:
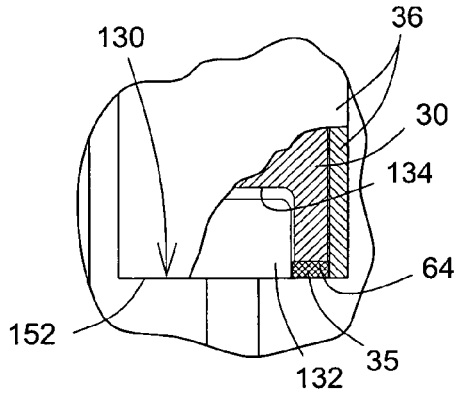
FIG. 3*a* is a partially broken enlarged side elevational view taken along line 3*a* of FIG. 3.

As shown in FIG. 3 and FIG. 3*a*, second upright 30 is similarly secured to impact plate 26 in second receptacle 36, which is attached to impact plate 26. Second receptacle 36 extends through impact plate 26 from second receptacle bottom end 152, situated proximally to wedges 27, 54 to generally opposed second receptacle top end 154, situated distally to wedges 27, 54. As best shown in FIG. 3*a*, Teflon™ washer 35 or the like is typically optionally placed in second receptacle 26 on support surface 130, which is situated at second receptacle bottom end 152 and has protrusion 132 extending therefrom. The protrusion 132, which extends through washer 35, is sized and shaped to extend into a corresponding cavity 134 defined by second upright 30. The second upright 30 is therefore vertically inserted through the second receptacle 36 for engaging protrusion 132 in cavity 134 and rests upon Teflon™ washer 35 situated on support surface 130. Second upright 30 is then secured to the impact plate 26 with a conventional fastening device 34 extending through a transversal bores 138, shown in FIG. 2, of second receptacle 36 and second upright 30 to prevent the latter from being detached from impact plate 26. Accordingly, second upright 30 is securely and releasably mounted in second receptacle 36 to secure, i.e. attach, second upright 30 to impact plate 26. Plunger 31 slidably and axially mounted on second upright 30 by means of plunger sleeves 100, best shown in FIG. 3, of plunger 31 which are sized and shaped to slidably and axially engage second upright 30. Once mounted on second upright 30, plunger 31 can be selectively lowered down against the impact plate 26, with the plunger bottom surface 66 resting on impact surface 70, indicated in FIG. 2, which faces away from wedge assembly 25. Plunger bottom surface 66 is adapted for integrally contacting impact surface 70, i.e. all of bottom surface 68 contacts impact surface 70, upon impact therewith with plunger 31. Thus, transfer of downwardly directed force from plunger 31 to impact plate 26 is facilitated when downwardly directed force is applied plunger 31 for splitting log L. The plunger cap 33 is then releasably fastened to the second upright top end 72, generally longitudinally opposed to second upright bottom end 64, to prevent upward movement of plunger 31 above second upright top end 72 of the second upright 30. Specifically, plunger cap 33 is sized and shaped for abutting engagement with plunger sleeves 100 to prevent movement thereof on second upright 30 beyond plunger cap 33 when plunger cap 33 is fastened to second upright 30 as shown. Plunger cap 33 therefore prevents plunger 31 from accidentally coming free of the second upright 30. This consolidation of these latter elements is referred to as Second Assembly B, shown in FIG. 2.

As will be plain to one skilled in the art and as best illustrated in FIG. 2, Second Assembly B can be easily attached and detached from first upright 24 of First Assembly A log splitting device 20. Thus, device 20 is modular, the primary modules thereof being First and Second Assemblies A, B and which can easily be attached and detached from each other for movement and storage of device 20, To further facilitate storage and movement of device 20, First Assembly A can be easily assembled and disassembled by detaching first upright 24 from first receptacle 23 by respectively inserting and removing fasting device 34. Second Assembly can be similarly assembled and disassembled, notably when plunger cap 33 is removed from second upright 30, by, respectively attaching and detaching second upright 30 to impact plate 26 in second receptacle 36 and by mounting and dismounting plunger 33 on second upright 30.

Figure 4:
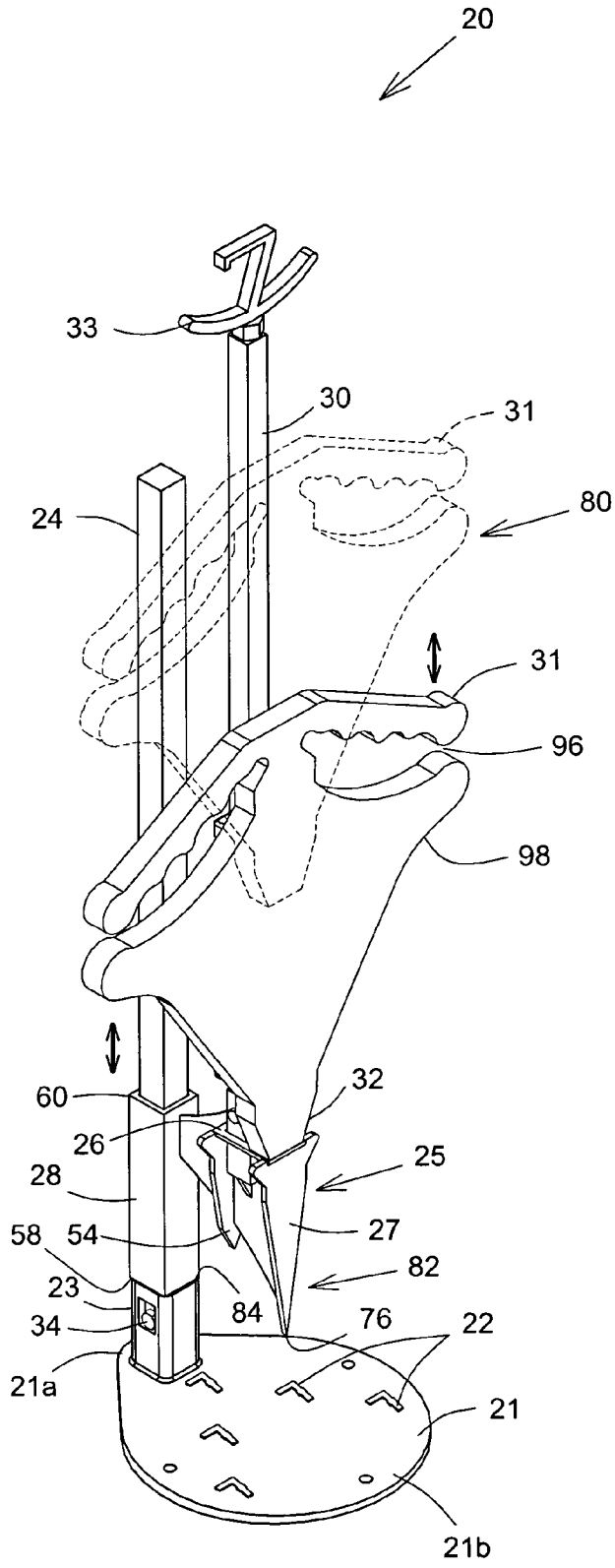
FIG. 4 is a top perspective view of the manual log splitting device shown in FIG. 1, illustrating second assembly of the device in a resting position.

To explain the log splitting procedure in greater detail, reference is now made to FIG. 1 in conjunction with FIGS. 3 and 4. As upright sleeve 28 is axially and slidably engageable on first upright 24, Second Assembly B is axially and slidably displaceable along first upright 24. To split log L, Second Assembly B is lifted by user by gripping impact plate 26 or upright sleeve 28 and exerting an upwardly directed force thereupon such that Log L can be placed upon base plate 21 for resting of log L thereupon underneath wedge assembly 25 which faces log L and base plate 21. Second Assembly B is then lowered on first upright 24 until wedge assembly 25 is in a pre-splitting position, shown generally as 78 in FIG. 1, in which at least first wedge 27, and specifically first wedge point 76 thereof, of wedge assembly 25 is resting in contact with log L. Plunger 31, axially and slidably mounted on second upright 30, is then axially and slidably raised above impact plate 26 to a raised position, shown generally as 80 in FIGS. 1 and 3, by user. User then applies a downwardly directed force on plunger 31 by pushing or pulling downwardly thereupon to move plunger 31 towards impact plate 26 for impacting impact plate 26 on impact surface thereof 70 with plunger bottom surface 66, thus applying the downwardly directed force to impact plate 26. The downwardly directed force on impact plate 26 causes Second Assembly B, and more specifically wedge assembly 25 facing base plate 21, to move towards base plate 21 and pass through log L, thus splitting log L. Movement towards base plate 21 of Second Assembly B does not extend, however, beyond resting position, shown generally as 82 in FIGS. 3 and 4, in which wedge assembly 25 is slightly spaced apart from base plate 21, say by about 2–3 inches or the like. Thus, when in resting position 82, wedge assembly 25 in no way comes into contact with the base plate 21 and accidentally the operator's foot. Generally, Second Assembly B will be in resting position 82 when device 20 is assembled and not in use.

Referring to FIGS. 3 and 4, to prevent Second Assembly B, and in particular wedge assembly 25 thereof, from moving beyond resting position 82 towards base plate 21, at least one of upright sleeve 28 and first receptacle 23, which extends upwardly away from base plate 21 and upwardly adjacent first upright 24, is sized and shaped such that upright sleeve bottom end 58 and first receptacle top end 84 abuttingly engage each other when Second Assembly B is in resting position 82. This abutting engagement of upright sleeve bottom end 58 and first receptacle top end 84 prevents Second Assembly B from moving beyond resting position 82 towards base plate 21. Accordingly, first receptacle 23 serves as an abutting engagement means for abutting engagement of upright sleeve 28 and base plate 21 for preventing movement of Second Assembly B towards base plate 21 beyond resting position 82. More specifically, first receptacle 23 provides an abutment protrusion, as abutting engagement means, that is situated between upright sleeve 23 and base plate 21 and which extends upwardly from base plate 21 and adjacent first upright 24 for abutting upright sleeve 28 when Second Assembly B is in resting position 82. It should be noted that first receptacle 23 could be replaced by any other means that could prevent downward movement of Second Assembly B towards base plate 21 when Second Assembly B is in resting position 82. Further, upright sleeve 28 could be sized and shaped such that upright sleeve 28 in itself could serve as the abutment means to prevent Second Assembly B from descending below resting position 82 towards base plate 21. For example, upright sleeve 28 could be sized and shaped such that upright sleeve 28 would extend further towards base plate 21 than wedge assembly 25 by a distance equivalent to that desired for the distance between base plate 21 and wedge assembly 25, or a point thereof such as first wedge point 76, for resting position 82. In such a case, upright sleeve bottom end 58 would abut base plate 21 to prevent further movement theretowards of Second Assembly B when the latter is in resting position 82. It should be noted that, since user can move Second Assembly B away from resting position 82, abutting engagement means, i.e. first receptacle 23 for the embodiment shown, provides the abutting engagement to prevent movement beyond resting position 82 on a selective basis, namely when user chooses to move Second Assembly B into or towards resting position 82.

Referring again to FIG. 3, base plate 21 is tapered in thickness, wherein the proximal end 21*a* of the plate 21 is thicker than the distal end 21*b*, for promoting stability of log L on base plate 21. To further improve stability of log L, base plate 21 is provided with one or more cold-punched stabilization relieves 22 extending upwardly away from the base plate top surface 50 thereof. Specifically, the relieves 22 abuttingly and grippingly engage the log L for stabilizing the log L upon base plate top surface 50 when the downwardly directed force on log L is applied by user thereupon using plunger 31 and wedge assembly 25 for splitting log L. Relieves 22 are typically arranged in a pattern of two intersecting lines, shown generally as 52. The two lines 52 of the pattern of relieves 22 typically intersect one another adjacent the first receptacle 23, and therefore in proximity to proximal end 21*a*. It should be noted that tapering of base plate 21 is optional and that base plate 21 could be of any shape without departing from the scope of the present invention. Further, while first upright 24 is shown as being square in shape, other shapes, quadrilateral or otherwise, are also possible provided first upright 24, or a portion thereof, guides upright sleeve 28 along first upright to maintain wedge assembly oriented above base plate 21 during splitting. Second upright 30 may also be shaped in forms other than a square, provided the shape allows second upright 30 to guide plunger 31 onto impact plate 26 during splitting. First upright 24 and second upright 30 may be either hollow or solid.

Also depicted in FIG. 2 is perspective view of plunger 31. To assist user in manipulating plunger 31, plunger has handles 88, one for each hand of user, which extend at least partially across plunger 31 to allow user to grasp plunger 31. To further facilitate grasping of plunger 31 for manipulation therefore, handles 88 have finger indentations 90 sized and shaped for placement of fingers therein for gripping handles 88. For the embodiment shown, each handle 88 is situated in proximity to plunger top end 92 which is situated generally opposite plunger bottom end 94 where plunger base 32 is situated. Thus, plunger bottom end 94 is situated proximal impact plate 26 compared to top plunger end 94 when plunger 31 is mounted on second upright 30. Referring again to FIG. 3, plunger 31 also has generally opposed angled plunger flanges 140 which extend, i.e. flare, radially upwardly away from plunger base 32. Each plunger flange 140 extends from plunger base 32 towards a respective handle 88 situated adjacently vertically thereabove and extending thereover. Further, each plunger flange 140 extends radially outwardly, i.e. horizontally, beyond the respective handle 88 to ensure that plunger flanges 140 deflect pieces of log L away from and beyond the handles 88 during downward movement of plunger 31 and Second Assembly B for splitting of log L. This serves to protect user's hands and wrists from pieces of log L while using handles 88 to apply the downwardly directed force during splitting of log L. Optionally, each handle 88 may be separated from respective plunger flange 140 by space 96 through which the user may pass the user's hand or a portion thereof, such as fingers, between plunger flange 140 and handle 88 to facilitate placement of hand on handle 88 and grasping thereof. Further, each plunger flange 140 may have an optional curved section 98 situated adjacently proximal to respective handle 88 situated thereabove and which curves radially away from the other flange 140 and radially beyond the respective handle 88. As can be seen, angle C defined by plunger flanges 140, i.e. between plunger flanges 140, is wider, i.e. greater, at curved sections 98 than angle D defined by plunger flanges 140 at plunger base 32.

Figure 5:
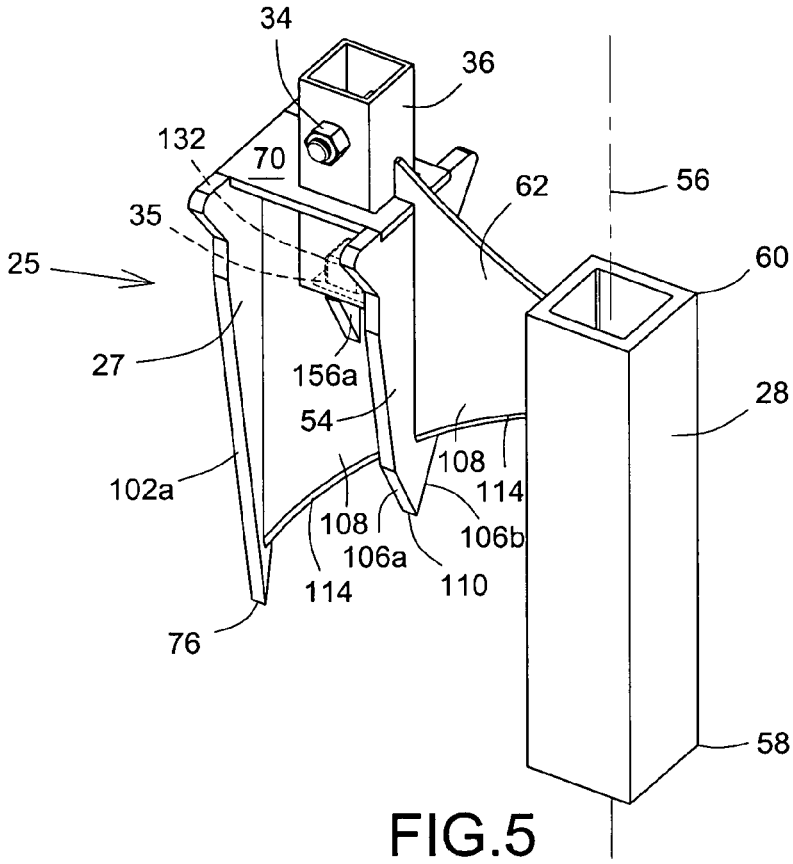
FIG. 5 is a side elevational view of the wedge assembly of the manual log splitting device shown in FIG. 1.
Figure 6:
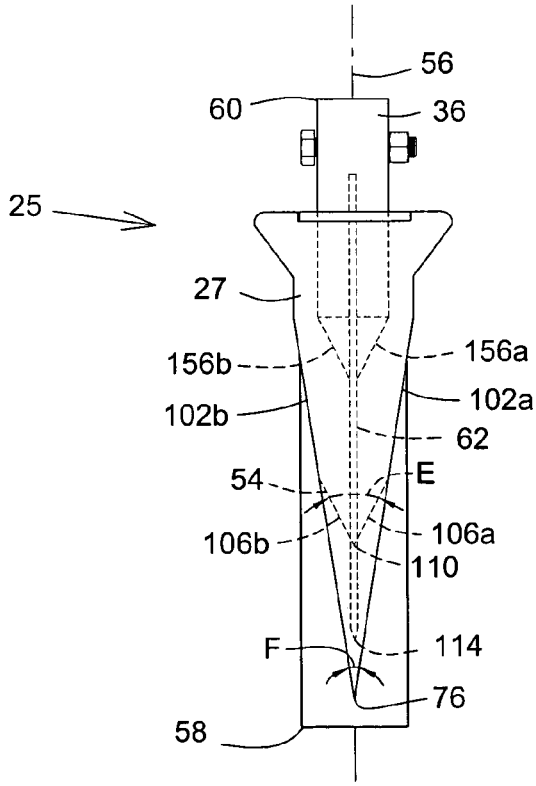
FIG. 6 is a front view of the wedge assembly of the manual log splitting device shown in FIG. 1.

FIGS. 5 and 6 depict the wedge assembly 25 in greater detail. As shown, wedge assembly 26 has first wedge 27, second wedge 54 made of a hard metal such as cast iron or the like. First wedge 27 is defined by first and second wedge flanges 102*a*, 102*b* which taper downwardly away from impact plate 26 to first wedge point 78 for cutting and penetrating log L during splitting. Similarly, second wedge 54 is defined third and fourth wedge flanges 106*a*, 106*b* which taper downwardly from impact plate 26 to second wedge point 110 for cutting and penetrating log L during splitting. Generally first wedge 27 and second wedge 54 are axially aligned, i.e. in parallel alignment, with first upright sleeve axis 56 and upright sleeve 28, with second wedge 54 being situated relatively proximal upright sleeve 28 compared to first wedge 27 and second wedge point 110 being situated relatively proximal to impact plate 26 compared to first wedge point 76. Generally, angle E defined by third and fourth wedge flanges 106*a*, 106*b* at second wedge point 110 is wider than the angle F defined by first and second wedge flanges 102*a*, 102*b* at first wedge point 76. Accordingly, second wedge 54 is generally shorter than first wedge 27 and is wider in angle at its respective wedge point 110 than first wedge 27.

Referring still to FIGS. 5 and 6, blade plate 62 is attached to first wedge 27, second wedge 54, upright sleeve 28, and impact plate 26 and extends radially with regard to first axis 56 from upright sleeve 28 to second wedge 54 and from second wedge 54 to first wedge 27. With regard to impact plate 26, blade plate 62 is attached thereto and extends downwardly away from impact plate 26 towards wedge points 76, 110. Thus, wedge assembly 25 and impact plate 26 are attached to upright sleeve 28 by blade plate 62 which extends downwardly relative to impact plate 26 towards wedge points 76, 110 and transversely from first wedge 27 to second wedge 54 and from second wedge 54 to upright sleeve 28.

Blade plate 62 defines blade 114, on a proximal edge 108 thereof, which extends between upright sleeve 28 to second wedge 54 and from second wedge 54 to first wedge 27 in proximity to wedge points 76, 110 and aligned therewith. More specifically, proximal edge 108, and therefore blade 114, is preferably shaped as an upwardly directed arc which curves upwardly towards first upright upper end 60 from first wedge 27, in proximity to first wedge point 76, through second wedge 54 in proximity to second wedge point 100 to upright sleeve 28.

Due to greater length of first wedge 27 relative second wedge 54, first wedge point 76 is the first part of wedge assembly 25 to contact and pass through log L, followed by wedge flanges 102*a*, 102*b*, for splitting log L. After first wedge 27 initially penetrates log L, second wedge point 110 contacts log L and wedge flanges 106*a*, 106*b* penetrate log L in a position relatively proximal upright sleeve 28 when compared to first wedge 27. As angle E of second wedge 54 is wider than angle F of first wedge 27, second wedge 54 facilitates splitting by forcing parts of log L already partially split by first wedge 27 further apart after initial penetration thereby. In addition, blade 114 penetrates log in between first and second wedges 27, 54 to further facilitate splitting. Use of blade plate 112, as opposed to a single conventional wedge formed of two intersecting surfaces extending transversely across a section of the log L, reduces the surface area of elements 27, 54, 76, 102, 106, 110, 114 of wedge assembly 25 and blade plate 62 that must penetrate and pass through log L. Thus, friction between wood of log L and wedge assembly 25 is reduced compared to a conventional wedge.

Wedge assembly 25 may also have optional fifth and sixth wedge flanges 156*a*, 156*b*, situated between first wedge 27 and second wedge 54, which taper downwardly from second receptacle bottom end 130 to blade plate 62. These wedge flanges 156 contact log L after wedges 27, 54 and blade plate 62 have at least partially passed therethrough and facilitate additional forcing apart of pieces of log L situated between wedges 27, 54. Further, by directing pieces of log L away from a portion of the blade plate 62 situated between wedges 27, 54 and from which wedge flanges 156 extend, wedge flanges 56 further reduce total surface area of wedge assembly 25, including elements 27, 54, 76, 102, 106, 110, 114, 156, and blade plate 62, that contact log L. Thus, friction between wood of log L and wedge assembly 25 is reduced even further compared to a conventional wedge.

Figure 7:
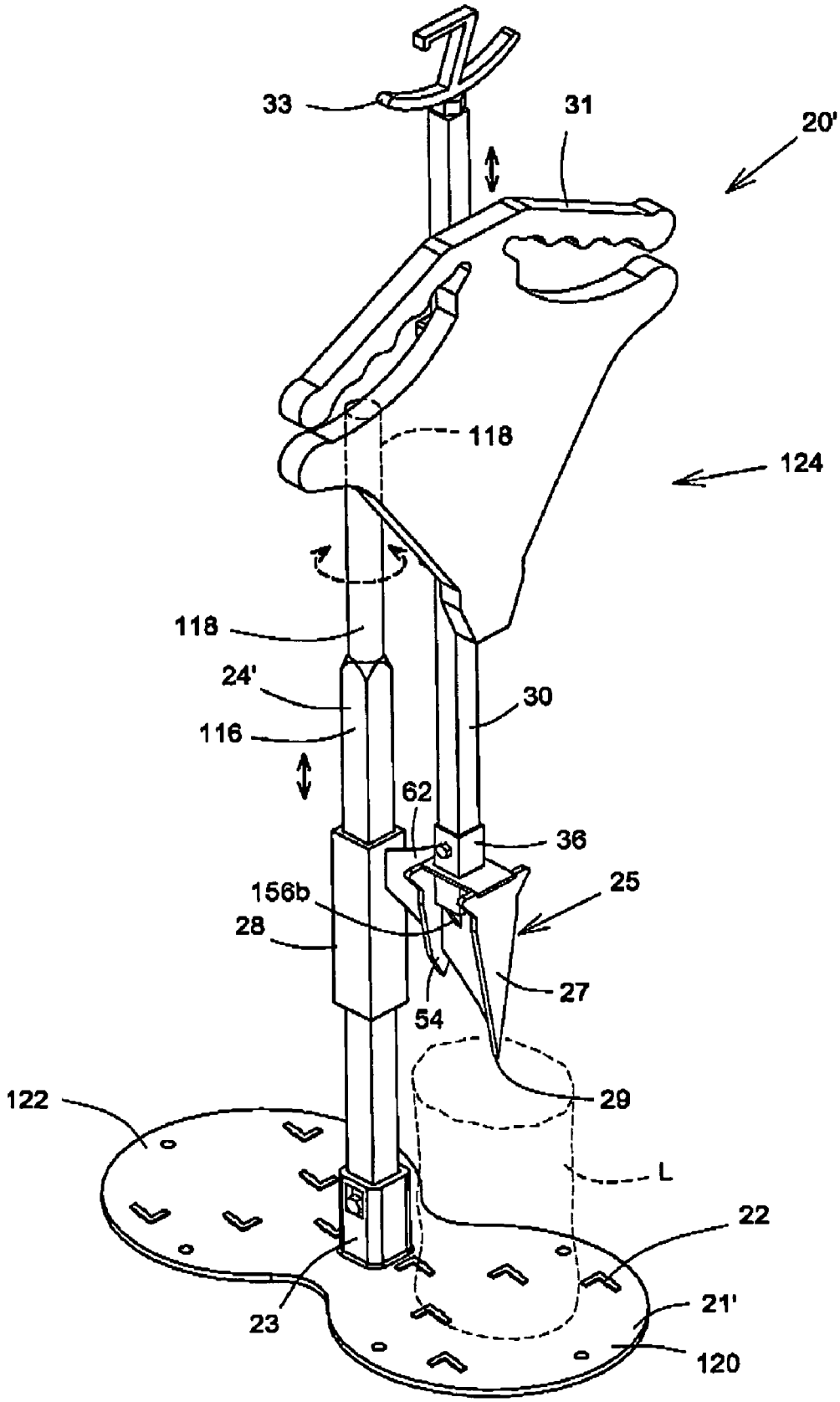
FIG. 7 is a top perspective view of a manual log splitting device in accordance with another embodiment of the present invention.
Figure 8:
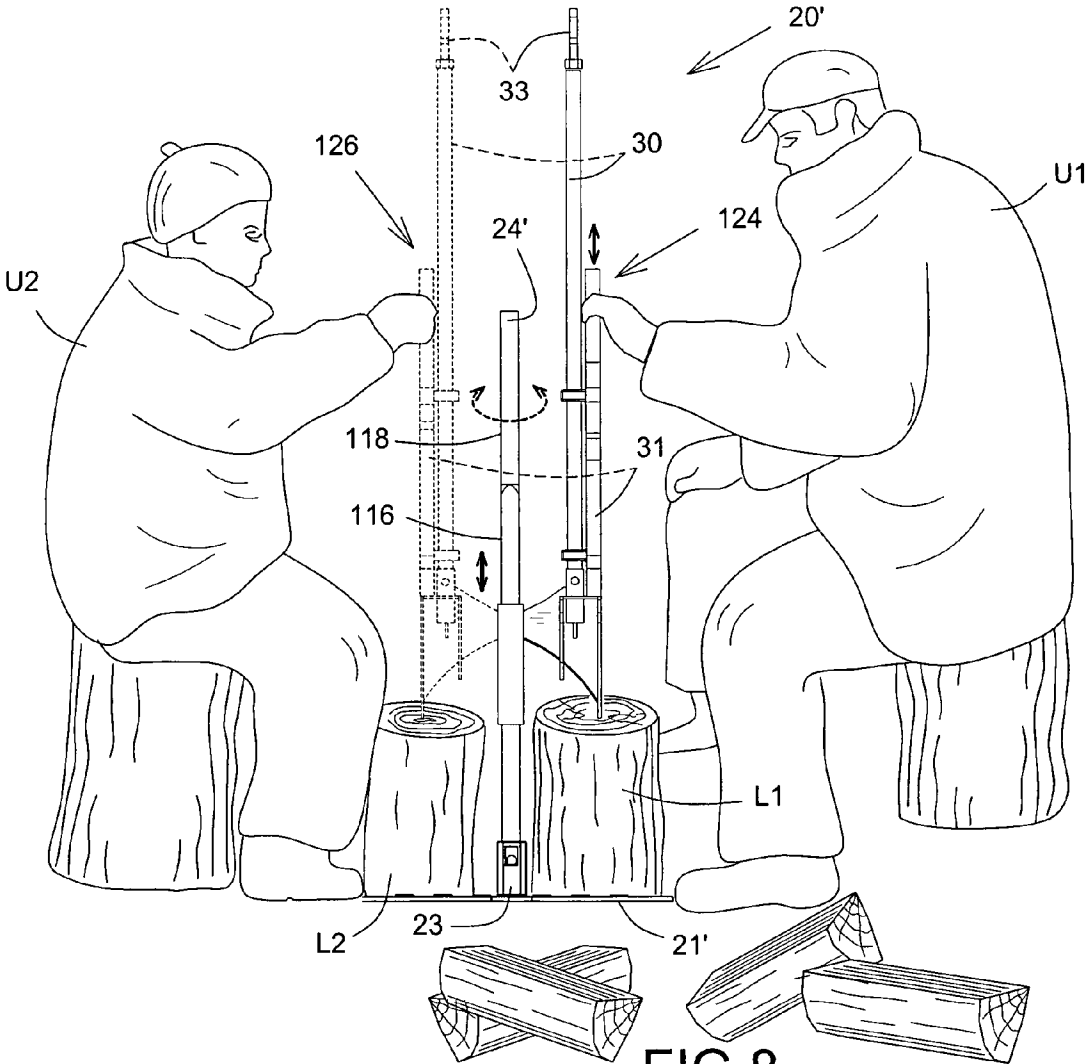
FIG. 8 is a side elevational view of the manual log splitting device shown in FIG. 6 and illustrating its use by two operators.

FIGS. 7 and 8 show another embodiment of the manual log splitting device of the present invention, shown generally as 20'. In brief, device 20' may be used alternately by first and second users U1, U2 by virtue of a modified first upright 24' and modified base plate 21' permitting the rotation around first upright 24' of Second Assembly B by 360 degrees, as illustrated in FIG. 7 by the double arrow in dotted lines.

First upright 24' of log splitting device 20' has a first upright lower section 116 attached, as previously explained, to modified base plate 21 and extending upwardly away therefrom and first upright upper section 118 extending upwardly away from first upright lower section 116. Modified base plate 21' comprises a first base plate portion 120 and a generally second base plate portion 122, between which modified first upright 24' is situated and extends upwardly therefrom. Each base plate portion 120, 122 is sized and shaped for placement, i.e. resting of a respective log L1, L2 thereupon for splitting thereof. First upright upper section 118 is cylindrically shaped and sized for rotation of upright sleeve 28, and thereby Second Assembly B, around first upright 24', as shown in FIG. 7, when upright sleeve 28 is slidably and axially raised completely above first upright lower section 116. Thus, Second Assembly B is rotatable upon upper section 118 of first upright 24' between a first user position, shown generally as 124, where wedge assembly 25 is situated above first base plate portion 120 for splitting log L1 placed thereon, and a second user position, shown generally as 126, where wedge assembly 25 is situated above second base plate portion 122 for splitting log L2 placed thereon.

First upright lower section 116 and upright sleeve 28 are shaped and sized to form abutting quadrilateral parallelograms, such as squares, and thereby prevent rotation of upright sleeve 28 therearound when upright sleeve 28 is at least partially situated on first upright lower section 116. Advantageously, since upright sleeve 28 cannot rotate around lower section 116 when upright sleeve 28 is situated thereupon, upright sleeve 28 and lower section 116 also guide Second Assembly B on said first upright 24' when Second Assembly B is moved downwardly thereupon for splitting logs L1, L2 by, respectively, users U1, U2.

Obviously, first upright lower section 116 could be shaped in a form other than a quadrilateral parallelogram provided lower section 116 is capable of preventing rotation of Second Assembly B therearound when upright sleeve 28 is situated thereupon. Further, it should be apparent to one skilled in the art that, should it not be necessary or desirable to prevent rotation of Second Assembly B around first upright lower section 116, first upright 24' could be cylindrical in shape through its entire length, including first upright lower and upper sections 116, 118, thus allowing Second Assembly B to be rotated around first upright 24' even when in resting position 82. Additionally, while the log splitting device 20 is made primarily of cast iron, other metals could be used. Further, methods other than casting may be used for forming the iron, or other metal, of component. For example, wedge assembly 25 or plunger 31 could be formed by using lasers or other means for cutting the iron or metal to the desired form.

Although the present invention has been described with a certain degree of particularity, it is to be understood that the disclosure has been made by way of example only and that the present invention is not limited to the features of the embodiments described and illustrated herein, but includes all variations and modifications within the scope and spirit of the invention as hereinafter claimed.

We claim:

1. A log splitting device for splitting logs, said device comprising:

a first assembly comprising a base plate for resting of at least one log during splitting of said log and a first upright supported by and extending upwardly from said base plate;

a second assembly comprising an upright sleeve having a first upright sleeve axis, an impact plate attached to said upright sleeve and extending substantially radially therefrom, a second upright attached to said impact plate and extending upwardly therefrom, a plunger axially and slidably mounted on said second upright, and at least one wedge assembly extending substantially axially away from said impact plate towards said base plate, said upright sleeve being axially and slidably engageable by said first upright for displacement of said second assembly therealong with said wedge assembly facing towards said base plate for splitting said log by passage therethrough when said second assembly is moved towards said base plate upon said first upright by a downwardly directed force applied by a user by sliding said plunger on said second upright from a raised position above said impact plate downwardly towards said impact plate and impacting said impact plate; and abutting engagement means for selectively abuttingly engaging said upright sleeve and said base plate when second assembly is in a resting position in which said wedge is slightly vertically spaced apart from said base plate for preventing further movement of said second assembly theretowards.

2. The log splitting device of claim 1, wherein said abutting engagement means comprises an abutment protrusion extending upwardly away from said base plate and adjacent said first upright.

3. The log splitting device of claim 2, wherein said abutment protrusion comprises a first receptacle attached to said base plate and extending upwardly therefrom from said base plate and adapted for abutting said upright sleeve.

4. The log splitting device of claim 3, wherein said first upright is releasably and securely engageable in said first receptacle.

5. The log splitting device of claim 1, wherein said base plate is tapered from a proximal end thereof towards a generally opposed distal end thereof of less thickness than said proximal end, said proximal end being situated proximal said abutting engagement means.

6. The log splitting device of claim 1, wherein said base plate comprises at least one relieve extending upwardly away from a base plate top surface of said base plate towards said second assembly, said log resting on said top base plate surface during splitting thereof and said relieve abuttingly and grippingly engaging said log for stabilizing said log upon said base plate top surface when said downwardly directed force is applied for splitting said log.

7. The log splitting device of claim 6, wherein said at least one relieve comprises a plurality of said relieves arranged to form two intersecting lines of said relieves, said two intersecting lines intersecting in proximity to said abutting engagement means.

8. The log splitting device of claim 1, wherein said impact plate comprises a second receptacle in which said second upright is releasably and securely mounted.

9. The log splitting device of claim 1, wherein said impact plate has an impact surface facing away from said wedge assembly and said plunger comprises a plunger base having a plunger bottom surface which faces said impact surface said plunger bottom surface being adapted for coming into complete contact with said top impact surface when said plunger impacts said impact plate.

10. The log splitting device of claim 9, wherein said plunger further comprises at least one handle connected thereto for grasping of said plunger therewith by said user with at least one hand thereof.

11. The log splitting device of claim 10, wherein said plunger further comprises a plunger top end and a generally opposed plunger bottom end, said plunger base being situated proximally to said plunger bottom end and said handle being situated proximally to said plunger top end.

12. The log splitting device of claim 11, wherein said at least one handle comprises two generally opposed handles, one said handle for each said hand, extending at least partially across said plunger.

13. The log splitting device of claim 12, wherein said plunger comprises two generally opposed angled plunger flanges, each said plunger flange flaring radially upwardly away from said plunger base and radially away from other said plunger flange towards a respective handle, situated thereabove, of said handles.

14. The log splitting device of claim 13, wherein each said plunger flange extends radially beyond said respective handle for deflecting pieces of said log split by said wedge assembly away from said handle during downward movement of said plunger and said wedge assembly into said log for splitting thereof.

15. The log splitting device of claim 14, each said plunger flange comprising a respective curved section situated adjacently proximally to said respective handle and curving radially away from opposing said plunger flange and radially beyond said respective hand grip, said plunger flanges defining a wider angle therebetween at said curved sections than at said plunger base.

16. The log splitting device of claim 13, wherein each said plunger flange is separated from said respective handle by a respective space for passage therethrough of at least a portion of said hand.

17. The log splitting device of claim 1, wherein said plunger further comprises at least one plunger sleeve for slidably and axially engaging said second upright for slidably and axially mounting said plunger thereupon.

18. The log splitting device of claim 1, wherein said second assembly further comprises a plunger cap and second upright comprises a second upright bottom end and a longitudinally opposed second upright top end, said second upright bottom end being attached to said impact plate, said plunger cap being releasably fastenable to said second upright top end and adapted for abutting engagement with said plunger at said second upright top end to prevent upward movement of said plunger above said second upright top end.

19. The log splitting device of claim 3, wherein said first upright comprises a first upright lower section situated in proximity to said base plate and extending upwardly therefrom and a first upright upper section extending upwardly away from said first upright lower section, said first upright upper section being cylindrically shaped and sized for rotation of said second assembly therearound when said upright sleeve is raised completely above said first upright lower section and is situated upon said first upright upper section.

20. The log splitting device of claim 19, wherein said first upright lower section and said upright sleeve are shaped and sized to prevent rotation of said upright sleeve therearound when said upright sleeve is at least partially situated on said first upright lower section, said first upright lower section guiding said upright sleeve, and thereby said second assembly, on said first upright when said second assembly is moved downwardly thereupon for splitting said log.

21. The log splitting device of claim 20, wherein said first upright lower section and said upright sleeve are shaped and sized to form respective quadrilateral parallelograms.

22. The log splitting device of claim 17, wherein said base plate comprises a first base plate portion and a generally opposed second base plate portion, said first upright being situated therebetween on said base plate, each said base plate portion being sized and shaped for placement of a respective log thereupon for splitting thereof, said second assembly being rotatable upon said first upright upper section between a first user position, wherein said wedge assembly is situated above said first base plate portion for splitting said respective log placed thereon, and a second user position, wherein said wedge is situated above said second base plate portion for splitting said respective log placed thereon.

23. The log splitting device of claim 1, wherein said second assembly further comprises a blade plate and said wedge assembly comprises a first wedge and a second wedge for splitting said log, said wedges extending downwardly away from said impact plate and axially towards said upright sleeve bottom end, said second wedge being situated between said first wedge and said upright sleeve, said first wedge being defined by first and second wedge flanges tapering downwardly away from said impact plate towards a first wedge point, said second wedge being defined by third and fourth wedge flanges tapering downwardly from said impact plate to a second wedge point situated vertically above said first wedge point, said blade plate being attached to said impact plate, said wedges, and said upright sleeve and defining a blade extending in an upwardly directed arc from said first wedge through said second wedge to said upright sleeve.

* * * * *